US009486896B2

(12) United States Patent
Zhang

(10) Patent No.: US 9,486,896 B2
(45) Date of Patent: Nov. 8, 2016

(54) ABRASIVE ARTICLE AND COATING

(71) Applicant: Han Zhang, Shrewsbury, MA (US)

(72) Inventor: Han Zhang, Shrewsbury, MA (US)

(73) Assignees: SAINT-GOBAIN ABRASIVES, INC., Worcester, MA (US); SAINT-GOBAIN ABRASIFS, Conflans-Sainte-Honorine (FR)

( * ) Notice: Subject to any disclaimer, the term of this patent is extended or adjusted under 35 U.S.C. 154(b) by 6 days.

(21) Appl. No.: 13/926,132

(22) Filed: Jun. 25, 2013

(65) Prior Publication Data

US 2014/0004316 A1 Jan. 2, 2014

Related U.S. Application Data

(60) Provisional application No. 61/665,521, filed on Jun. 28, 2012.

(51) Int. Cl.

| | |
|---|---|
| ***B24D 18/00*** | (2006.01) |
| ***B24D 3/00*** | (2006.01) |
| ***B24D 7/04*** | (2006.01) |

(52) U.S. Cl.

CPC ..... *B24D 18/00* (2013.01); *B24D 3/004* (2013.01); *B24D 7/04* (2013.01); *Y10T 428/24777* (2015.01); *Y10T 428/24983* (2015.01); *Y10T 428/265* (2015.01); *Y10T 428/31678* (2015.04); *Y10T 428/31786* (2015.04); *Y10T 428/31935* (2015.04); *Y10T 428/31938* (2015.04)

(58) Field of Classification Search

CPC ..... B24D 18/00; B24D 3/004; B24D 7/04; Y10T 428/31935; Y10T 428/24777; Y10T 428/31786; Y10T 428/31938; Y10T 428/24983; Y10T 428/265; Y10T 428/31678

USPC ..... 428/192, 217, 336, 446, 457, 702, 480, 428/522, 523, 689, 698, 707, 469, 141–150

See application file for complete search history.

(56) References Cited

U.S. PATENT DOCUMENTS

| | | | |
|---|---|---|---|
| 2,307,461 | A | 1/1943 | Guth |
| 2,398,224 | A | 4/1946 | Hackett |
| 3,053,384 | A | 9/1962 | Loomis |
| 3,135,590 | A | 6/1964 | Campbell |
| 3,393,798 | A | 7/1968 | Beers |

(Continued)

FOREIGN PATENT DOCUMENTS

| | | |
|---|---|---|
| CN | 201052598 | 4/2008 |
| CN | 101318313 | 12/2008 |

(Continued)

OTHER PUBLICATIONS

Author Unknown, Feb. 9, 2016, Definition of "Bonded" and "Bond," Retried via Google search.*

(Continued)

*Primary Examiner* — Nathan Van Sell

(74) *Attorney, Agent, or Firm* — Abel Law Group, LLP; Thomas Osborn

(57) ABSTRACT

An abrasive article includes a body having an abrasive portion. The abrasive portion includes a bond material and abrasive particles located within the bond material. The body also comprises a coating coupled to and overlying at least a portion of an exterior surface of the abrasive portion. The coating has a water vapor transmission rate of not greater than about 2 g/m$^2$-day.

20 Claims, 3 Drawing Sheets

(56) References Cited

U.S. PATENT DOCUMENTS

| | | | | |
|---|---|---|---|---|
| 3,619,151 | A | 11/1971 | Sheets, Jr. et al. | |
| 3,724,160 | A | 4/1973 | Rechberger | |
| 3,734,336 | A | 5/1973 | Rankow et al. | |
| 4,021,208 | A * | 5/1977 | Oberbichler | 51/295 |
| 4,036,360 | A | 7/1977 | Deffeyes | |
| 4,047,903 | A | 9/1977 | Hesse et al. | |
| 4,239,501 | A | 12/1980 | Wirth et al. | |
| 4,294,357 | A | 10/1981 | Stevens et al. | |
| 4,380,447 | A | 4/1983 | VanderLugt, Jr. | |
| 4,871,376 | A | 10/1989 | DeWald | |
| 4,877,420 | A | 10/1989 | Buxbaum et al. | |
| 4,918,116 | A | 4/1990 | Gardziella et al. | |
| 4,947,990 | A | 8/1990 | Klemets | |
| 5,042,991 | A | 8/1991 | Kunz et al. | |
| 5,079,875 | A | 1/1992 | Unno et al. | |
| 5,116,392 | A | 5/1992 | Selgrad et al. | |
| 5,127,924 | A | 7/1992 | Russell | |
| 5,487,940 | A | 1/1996 | Bianchini et al. | |
| 5,505,950 | A | 4/1996 | Floyd et al. | |
| 5,626,945 | A | 5/1997 | Berzins et al. | |
| 5,908,649 | A | 6/1999 | Floyd et al. | |
| 6,003,674 | A | 12/1999 | Brooks | |
| 6,050,400 | A | 4/2000 | Taskis et al. | |
| 6,270,543 | B1 | 8/2001 | Gagliardi et al. | |
| 6,419,966 | B1 | 7/2002 | Davis | |
| 6,460,694 | B1 | 10/2002 | Khanna et al. | |
| 6,749,496 | B2 | 6/2004 | Mota et al. | |
| 6,764,574 | B1 | 7/2004 | Obeng | |
| 6,941,561 | B1 | 9/2005 | Kasichainula et al. | |
| 6,949,129 | B2 | 9/2005 | Simon | |
| 7,661,247 | B2 | 2/2010 | Schwabel et al. | |
| 8,758,461 | B2 | 6/2014 | Yener et al. | |
| 2001/0002360 | A1 | 5/2001 | Shiga | |
| 2002/0050513 | A1 | 5/2002 | Player et al. | |
| 2004/0173670 | A1 | 9/2004 | Snyder | |
| 2005/0133579 | A1 | 6/2005 | Smorch et al. | |
| 2006/0000731 | A1 | 1/2006 | Hayne et al. | |
| 2006/0003121 | A1 | 1/2006 | Scheller | |
| 2007/0000214 | A1 | 1/2007 | Schwabel et al. | |
| 2007/0125674 | A1 | 6/2007 | Ficai | |
| 2008/0202821 | A1 | 8/2008 | McClain et al. | |
| 2009/0017727 | A1* | 1/2009 | Pribyl et al. | 451/28 |
| 2009/0022434 | A1* | 1/2009 | Chiba | B01D 53/261 383/109 |
| 2011/0053479 | A1 | 3/2011 | Kim et al. | |
| 2011/0155593 | A1 | 6/2011 | Zhang et al. | |
| 2012/0006818 | A1 | 1/2012 | Fester et al. | |

FOREIGN PATENT DOCUMENTS

| | | | |
|---|---|---|---|
| CN | 101804602 | | 8/2010 |
| CN | 103641967 | | 3/2014 |
| CN | 203460070 | | 3/2014 |
| CN | 103709349 | | 4/2014 |
| DE | 10139533 | | 2/2003 |
| EP | 0236877 | A2 | 9/1987 |
| EP | 0904955 | A1 | 3/1999 |
| EP | 1795463 | A2 | 6/2007 |
| EP | 2361851 | | 8/2011 |
| GB | 696379 | | 8/1953 |
| GB | 701431 | | 12/1953 |
| GB | 781351 | | 8/1957 |
| GB | 1249050 | A | 10/1971 |
| JP | H01246078 | | 10/1989 |
| JP | H02232171 | | 9/1990 |
| JP | H06126638 | | 5/1994 |
| JP | H07309375 | A | 11/1995 |
| JP | 2001088036 | A | 4/2001 |
| JP | 2002370750 | A | 12/2002 |
| JP | 2005029211 | A | 2/2005 |
| JP | 2005272009 | A | 10/2005 |
| JP | 2005319556 | | 11/2005 |
| JP | 2007039096 | A | 2/2007 |
| JP | 2008013198 | A | 1/2008 |
| JP | 2008037066 | A | 2/2008 |
| JP | 4199126 | B2 | 12/2008 |
| JP | 2009500250 | A | 1/2009 |
| JP | 4410213 | | 2/2010 |
| KR | 100537092 | B1 | 12/2005 |
| KR | 10-2008-0031221 | A | 4/2008 |
| NO | 19800001902 | A | 12/1980 |
| RU | 2205738 | C2 | 6/2003 |
| SU | 472783 | | 6/1975 |
| TW | 201119799 | | 6/2011 |
| WO | 2007005628 | A1 | 1/2007 |
| WO | 2008057045 | A | 5/2008 |
| WO | 2008103417 | A1 | 8/2008 |

OTHER PUBLICATIONS

Tyrolit product packaging, 2009.

International Search Report, from PCT/US2010/062421 dated Jul. 28, 2011.

* cited by examiner

ABRASIVE ARTICLE AND COATING

This application claims priority to and the benefit of U.S. Provisional App. No. 61/665,521, filed Jun. 28, 2012, and is incorporated herein by reference in its entirety.

BACKGROUND

1. Field of the Disclosure

The present invention relates in general to abrasive articles and, in particular, to coated abrasive articles.

2. Description of the Related Art

Abrasive wheels are typically used for cutting, abrading, and shaping of various materials, such as stone, metal, glass, plastics, among other materials. Generally, the abrasive wheels can have various phases of materials including abrasive grains, a bonding agent, and some porosity. Depending upon the intended application, the abrasive wheel can have various designs and configurations. For example, for applications directed to the finishing and cutting of metals, some abrasive wheels are fashioned such that they have a particularly thin profile for efficient cutting.

However, given the application of such wheels, the abrasive articles are subject to fatigue and failure. In fact, the wheels may have a limited time of use of less than a day depending upon the frequency of use. Accordingly, the industry continues to demand abrasive wheels capable of improved performance.

BRIEF DESCRIPTION OF THE DRAWINGS

So that the manner in which the features and advantages of the embodiments are attained and can be understood in more detail, a more particular description may be had by reference to the embodiments thereof that are illustrated in the appended drawings. However, the drawings illustrate only some embodiments and therefore are not to be considered limiting in scope as there may be other equally effective embodiments.

The use of the same reference symbols in different drawings indicates similar or identical items.

DETAILED DESCRIPTION

The following is directed to abrasive tools having abrasive particles contained within a bond material (e.g., fixed abrasives, coated abrasives or bonded abrasives) for conducting material removal operations on workpieces. Certain embodiments herein are directed to bonded abrasive wheels, which may be used for cutting or grinding metal workpieces, including metals of titanium or stainless steel. However, the features of the embodiments herein may be applicable to other abrasive technologies.

Thin Wheels

The wheel may have a thickness, measured, e.g., at the periphery of the wheel. In some designs the thickness of wheel remains the same or essentially the same along a radial direction from the central opening to the outer edge (periphery) of the wheel. In other designs, the wheel thickness can vary (can increase or decrease) along a radial distance from the central opening to its periphery. In some cases, the thickness of the wheel is less than about 6.5 mm, for example, less than about 6 mm, less than about 4.8 mm, less than about 3.5 mm, less than about 3.2 mm, less than about 3 mm, less than about 2.5 mm, or even less than about 1.5 mm, and is at least about 0.8 mm. Some aspects also can be practiced with wheels having a different thickness. In some cases, the wheels described herein may be referred to as a "thin" wheel or hand-held, i.e., wheels that have a thickness no greater than about 6.5 mm.

The abrasive wheels described herein can have an outer diameter that is at least about 50 mm, such as at least about 75 mm. The diameter may be greater, such as at least about 100 mm, at least about 115 mm, at least about 125 mm, or at least about 150 mm. In particular instances, diameter 111 is within a range between about 50 mm and 250 mm, such as between about 75 mm and about 230 mm.

Figure 1:
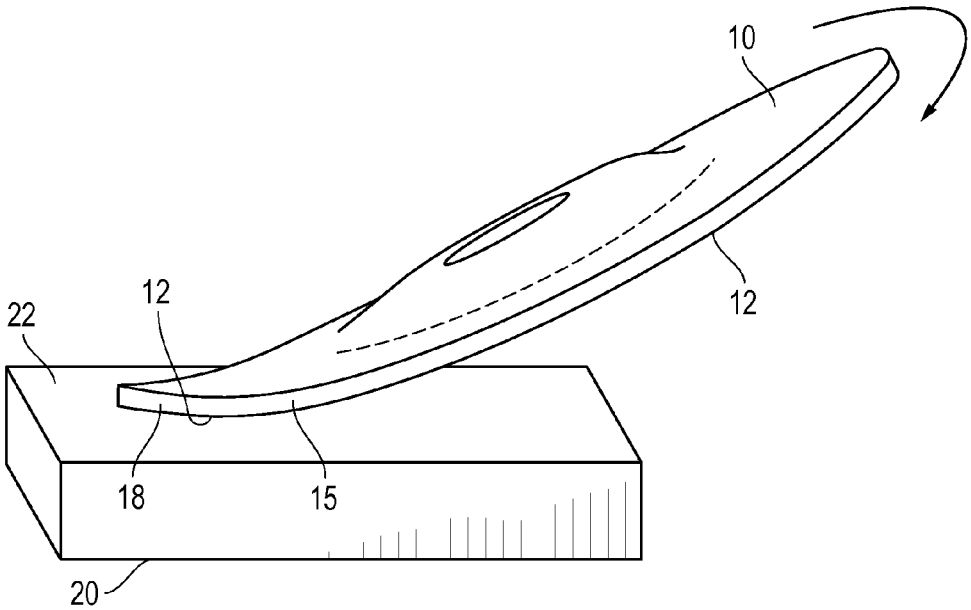
FIG. 1 is a view of a workpiece being processed by an abrasive article.

Ratios between wheel diameter and wheel thickness (diameter:thickness) can be within a range between about 125:1 to about 15:1, e.g., between about 100:1 to about 30:1. It can be practiced with wheels having different dimensions and different ratios between dimensions. Aspects may generally relate to wheels that have reduced stiffness. Such wheels are also referred to herein as pliable or compliant. Compliance of the wheel can be described by its ability to deflect, and wheels are capable of limited deflection without breaking. As shown in FIG. 1, a pliable or compliant wheel 10 is rotated, as indicated by the arrow, against surface 22 of workpiece 20. As outer portion 12 of wheel 10 contacts and grinds the workpiece, it can be deflected out of plane with the rest of the body of the wheel, thus enhancing contact with the workpiece being processed.

Bonded abrasive tools such as reinforced wheels, can be prepared by combining abrasive grains, a bonding material, e.g., an organic (resin), and in many cases other ingredients, such as, for instance, fillers, processing aids, lubricants, crosslinking agents, antistatic agents and so forth.

The various ingredients can be added in any suitable order and blended using, e.g., known techniques and equipment such as, for instance, Eirich mixers, e.g., Model RV02, Littleford, bowl-type mixers and others. The resulting mixture can be used to form a green body. As used herein, the term "green" refers to a body which maintains its shape during the next process step, but generally does not have enough strength to maintain its shape permanently; resin bond present in the green body is in an uncured or unpolymerized state. The green body preferably is molded in the shape of the desired article, e.g., a wheel (cold, warm or hot molding).

One or more reinforcements, e.g., fiberglass webs such as described herein, can be incorporated in the green body. For example, a first portion of a mixture containing abrasive grains and bonding material can be placed and distributed at the bottom of an appropriate mold cavity and then covered with a first reinforcement. A suitable reinforcement is a fiberglass mesh or web such as described herein. A second portion of the bond/abrasive mixture can then be disposed and distributed over the first reinforcement layer. Additional reinforcement and/or bond/abrasive mixture layers can be provided, if so desired. The amounts of mix added to form a particular layer thickness can be calculated as known in the art. Other suitable sequences and/or techniques can be employed to shape the reinforced green body. For instance, a piece of paper or a fiberglass mesh or web or a piece of paper with a fiber glass mesh or web may be inserted in the mold cavity before the first mixture.

In some arrangements the various layers containing abrasive grains and bond (also referred herein as "mix layers") can differ from one another with respect to one or more characteristics such as, for instance, layer thickness, layer formulation (e.g., amounts and or types of ingredients being employed, grit size, grit shape, porosity and so forth). To form such a wheel, a first mix layer, a1 (containing abrasive grains and bond), is laid at the bottom of the mold. A first reinforcement V1 is laid on top, followed by a second layer, a2, which can be the same or different from a1. A second reinforcement, V2 (which can be the same or different from V1), is disposed over a2. If desired, a third mix layer, a3, that includes abrasive grains and bond can be used to cover V2. The third layer can be the same or different with respect to a1 and/or a2. Additional reinforcements and layers can be added, essentially as described, to obtain the desired number of layers and reinforcements. In another approach, a first reinforcement V1 is placed at the very bottom of the mold and covered by a first mix a1, with additional layers and reinforcements being disposed as described above. Arrangements in which adjacent mix layers ax and ay are not separated by a reinforcement also are possible, as are those in which two or more reinforcement layers, e.g., Vx and Vy, are not separated by a mix layer.

The individual thicknesses of the mix layers can be substantially the same. In certain instances, the thicknesses of the mix layers can be different, even significantly different. For example, the difference in thickness between two abrasive layers can be at least about 5% different, at least about 10% different, at least about 20% different, at least about 25% different, at least about 30% different, or even at least about 50% different. Engineered differences in the thicknesses between two abrasive layers can promote certain mechanical properties and advantages in grinding performance. In addition or alternatively to thickness variations, mix layers and/or reinforcements may differ with respect to formulation, materials employed and/or other properties.

Techniques that can be used to produce the bonded abrasive article, e.g., a reinforced wheel, include, for example, cold pressing, warm pressing or hot pressing. Cold pressing, for instance, is described in U.S. Pat. No. 3,619,151, which is incorporated herein by reference. During cold pressing, the materials in the mold are maintained at ambient temperature, e.g., normally less than about 30° centigrade (C). Pressure is applied to the uncured mass of material by suitable means, such as a hydraulic press. The pressure applied can be, e.g., in the range of about 70.3 kg/cm2 (0.5 tsi) to about 2109.3 kg/cm2 (15 tsi), and more typically in the range of about 140.6 kg/cm2 (1 tsi) to about 843.6 kg/cm2 (6 tsi). The holding time within the press can be, for example, within the range of from about 2.5 seconds to about 1 minute.

Warm pressing is a technique very similar to cold pressing, except that the temperature of the mixture in the mold is elevated, usually to a temperature below about 120° C., and more often, below about 100° C. Suitable pressure and holding time parameters can be, for example, the same as in the case of cold pressing.

Hot pressing is described, for example, in a Bakelite publication, Rutaphen™—Resins for Grinding Wheels—Technical Information. (KN 50E-09.92-G&S-BA), and in Another Bakelite publication: Rutaphen Phenolic Resins—Guide/Product Ranges/Application (KN107/e-10.89 GS-BG). Useful information can also be found in Thermosetting Plastics, edited by J. F. Monk, Chapter 3 ("Compression Moulding of Thermosets"), 1981 George Goodwin Ltd. in association with The Plastics and Rubber Institute. For the purpose of this disclosure, the scope of the term "hot pressing" includes hot coining procedures, which are known in the art. In a typical hot coining procedure, pressure is applied to the mold assembly after it is taken out of the heating furnace.

To illustrate, an abrasive article can be prepared by disposing layers of a mixture including abrasive grains, bond material and, optionally, other ingredients, below and above one or more reinforcement layer(s) in an appropriate mold, usually made of stainless-, high carbon-, or high chrome-steel. Shaped plungers may be employed to cap off the mixture. Cold preliminary pressing is sometimes used, followed by preheating after the loaded mold assembly has been placed in an appropriate furnace. The mold assembly can be heated by any convenient method: electricity, steam, pressurized hot water, hot oil or gas flame. A resistance- or induction-type heater can be employed. An inert gas like nitrogen may be introduced to minimize oxidation during curing.

The specific temperature, pressure and time ranges can vary and will depend on the specific materials employed, the type of equipment in use, dimensions and other parameters. Pressures can be, for example, in the range of from about 70.3 kg/cm.sup.2 (0.5 tsi) to about 703.2 kg/cm2 (5.0 tsi), and more typically, from about 70.3 kg/cm2 (0.5 tsi) to about 281.2 kg/cm2 (2.0 tsi). The pressing temperature for this process is typically in the range of about 115° C. to about 200° C.; and more typically, from about 140° C. to about 190° C. The holding time within the mold is usually about 30 to about 60 seconds per millimeter of abrasive article thickness.

A bonded abrasive article is formed by curing the organic bonding material. As used herein, the term "final cure temperature" is the temperature at which the molded article is held to effect polymerization, e.g., cross-linking, of the organic bond material, thereby forming the abrasive article. As used herein, "cross-linking" refers to the chemical reaction(s) that take(s) place in the presence of heat and often in the presence of a cross-linking agent, e.g., "hexa" or hexamethylenetetramine, whereby the organic bond composition hardens. Generally, the molded article is soaked at a final cure temperature for a period of time, e.g., between 6 hours and 48 hours, e.g., between 10 and 36 hours, or until the center of mass of the molded article reaches the cross-linking temperature and desired grinding performance (e.g., density of the cross-link)

Selection of a curing temperature depends, for instance, on factors such as the type of bonding material employed, strength, hardness, and grinding performance desired. In many cases the curing temperature can be in the range of from about 150° C. to about 250° C. In more specific embodiments employing organic bonds, the curing temperature can be in the range of about 150° C. to about 230° C. Polymerization of phenol based resins, for example, generally takes place at a temperature in the range of between about 110° C. and about 225° C. Resole resins generally polymerize at a temperature in a range of between about 140° C. and about 225° C. and novolac resins generally at a temperature in a range of between about 110° C. and about 195° C.

To illustrate, a green body for producing a reinforced bonded abrasive article may be pre-heated to an initial temperature, e.g., about 100° C. where it is soaked, for instance, for a time period, from about 0.5 hours to several hours. Then the green body is heated, over a period of time, e.g. several hours, to a final cure temperature where it is held or soaked for a time interval suitable to effect the cure. Once the bake cycle is completed, the abrasive article, e.g., the reinforced wheel, can be air-cooled. If desired, subsequent steps such as edging, finishing, truing, balancing and so forth, can be conducted according to standard practices.

The Coating

Figure 2:
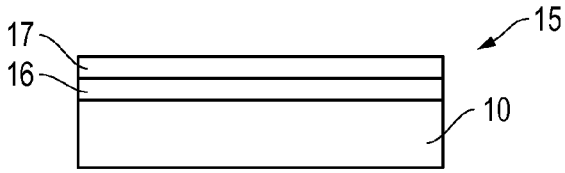
FIG. 2 is a sectional view of an abrasive article.

In an embodiment illustrated in FIG. 2, an abrasive article 10 includes a coating 15 coupled to and overlying at least a portion of an exterior surface of the abrasive article 10. The abrasive article may include a body having an abrasive portion. The abrasive portion can include a bond material and abrasive particles located within the bond material. The coating can be less abrasive than the abrasive portion. The coating can be non-abrasive. The abrasive portion can have an abrasive hardness, and the coating can have a coating hardness that is less than the abrasive hardness.

In an exemplary embodiment, a coated abrasive article includes abrasive grains embedded in a polymer matrix. The polymer matrix can be hygroscopic. The coating can have a water vapor transfer rate (WVTR) of not greater than about 2.0 $g/m^2$-day (i.e., grams per square meter, per 24 hours). In other embodiments, the WVTR can be not greater than about 1.5 $g/m^2$-day, such as not greater than about 1 $g/m^2$-day, not greater than about 0.1 $g/m^2$-day, not greater than about 0.015 $g/m^2$-day, not greater than about 0.010 $g/m^2$-day, not greater than about 0.005 $g/m^2$-day, not greater than about 0.001 $g/m^2$-day, or even not greater than about 0.0005 $g/m^2$-day. In another embodiment, the coating WVTR can be at least 0.00001 $g/m^2$-day. In other examples, the coating WVTR can be in a range between any of these values.

Embodiments of the coating may directly contact the abrasive portion. At least a portion of the coating may directly contact and be bonded to the bond material. In other embodiments, at least a portion of the coating directly contacts and is bonded to the abrasive particles. The coating may be bonded directly to at least a portion of the abrasive portion and configured to be selectively removable when the abrasive portion is used. For example, in FIG. 1, the coating 15 is shown as shaded, but has been removed from portion 18 of the abrasive portion due to use. Alternatively, the coating may be bonded directly to at least a portion of the abrasive portion and configured to be selectively volatilized as the coating contacts a workpiece during use of the abrasive article. Thus, in some embodiments, the coating is designed to be only temporary until use, such that it becomes non-permanent upon use.

In other embodiments, the coating may comprise a material with performance properties similar to the materials disclosed in U.S. Pat. App. Pub. 2011/0155593 A1, published Jun. 30, 2011, which is incorporated herein by reference in its entirety. The coating may comprise a robust coating, such as a coating that is resilient and substantially impervious to normal manufacturing and customer handling requirements. Thus, the integrity and performance of the coating may remain until it is intentionally removed from the abrasive article during the initial operational use of the abrasive article. In this sense, the coating may be harder, tougher, thicker, more durable, etc. than conventional packaging for abrasive articles.

In still other embodiments, the coating may further comprise a desiccant layer located between an exterior of the coating and the abrasive article. For example, the abrasive article initially may be at least partially coated with a desiccant layer, and then an outer barrier layer may be applied over the desiccant layer. Such embodiments may further enhance the performance properties of the coating.

In a particular example, the desiccant layer is applied to the abrasive article prior to a second protective coating having the requisite WVTR. The desiccant layer may comprise an inorganic coating, water-absorbing polymers (e.g., high molecular weight poly acrylates), polyethylene oxides, poly vinylpyrolidones, and any combination thereof.

Figure 3:
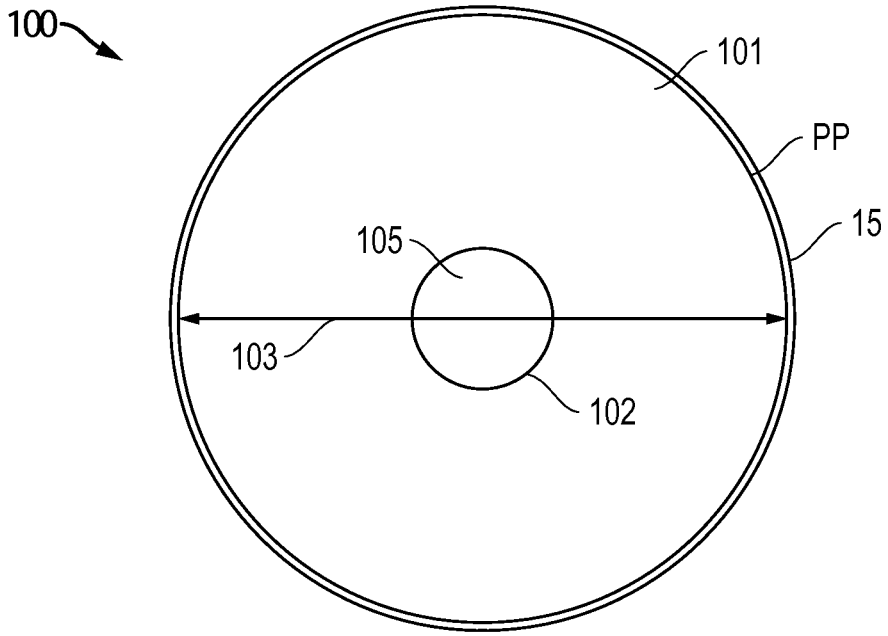
FIG. 3 includes an illustration of an abrasive tool in accordance with an embodiment.
Figure 4:
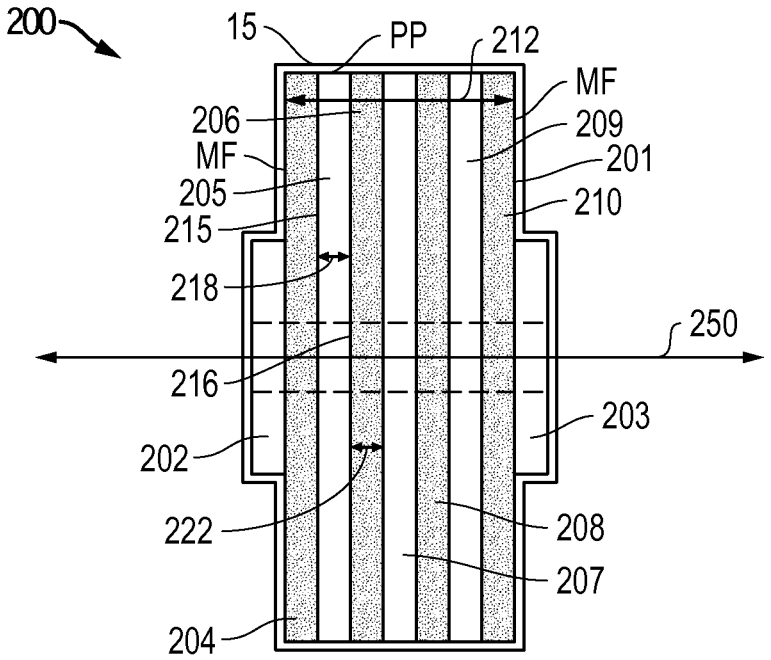
FIG. 4 includes a sectional illustration of a portion of an abrasive tool in accordance with an embodiment.

As illustrated in FIGS. 3 and 4, the body may include a peripheral portion PP and the abrasive portion is at least partially disposed at the peripheral portion. The coating 15 may be configured to overlay the abrasive portion at the peripheral portion PP. The coating may overlay a majority of the peripheral portion. In other embodiments, the coating can overlay essentially an entirety of the peripheral portion.

In a particular embodiment, the body may include a first major face MF (FIG. 4) defining a working surface, and the abrasive portion is disposed at the working surface. The coating 15 may overlay a majority of the major face MF that defines the working surface. Alternatively, the coating can overlay essentially an entirety of the working surface.

In other embodiments, the coating overlies a majority of the exterior surface of the abrasive portion. In addition, the coating can overlay essentially an entirety of the exterior surface of the abrasive portion.

In a particular version, the coating can overlay at least a portion of an exterior surface of the body. The coating also can overlay a majority of the exterior surface of the body. Alternatively, the coating can overlay essentially the entire exterior surface of the body.

Returning to FIG. 2, the coating 15 can be formed as a single layer structure or can include more than one layer. For example, the coating 15 can include a first film 16 and, optionally, a second film 17. The one or more films or layers of the coating 15 can be secured to each other through lamination or with an adhesive (not shown).

The first film may directly contact a portion of the body. The first film may be disposed between the body and the second film. The first film may directly contact a portion of the abrasive portion. The second film may directly contact the first film. The first film and the second film may be the same. The first film and the second film may be different from each other. The first film and the second film may include a metal, aluminum, copper, nickel, alloys, polymer, polyester, polyethylene terephthalate, liquid crystal polymer, aromatic polyester polymers, and a combination thereof.

Embodiments of the coating can include an organic material, inorganic material, and a combination thereof. The coating can include an oxide, carbide, nitride, SiC, polyethylene, saran, and a combination thereof.

In an example, each film or layer of the coating can be formed of a metal layer or a polymeric material. For example, a metal can include aluminum, copper, nickel or alloys thereof. An exemplary polymer can include a polyester. In an example, the polyester includes a polyethylene terephthalate, liquid crystal polymer, or any combination thereof. An exemplary liquid crystal polymer includes aromatic polyester polymers, such as those available under tradenames XYDAR® (Amoco), VECTRA® (Hoechst Celanese), SUMIKOSUPER™ or EKONOL™ (Sumitomo Chemical), DuPont HX™ or DuPont ZENITE™ (E.I. DuPont de Nemours), RODRUN™ (Unitika), GRANLAR™ (Grandmont), or any combination thereof.

The coating can have a thickness of at least about 0.2 microns. For example, the coating can have a thickness of at least about 0.5 microns, such as at least about 1 micron, at least about 10 microns, at least about 100 microns, at least about 125 microns, or even at least about 500 microns.

Embodiments of the abrasive portion can have an average thickness measured in an axial direction of the body. The coating can have a coating thickness that is not greater than about 1% of the average thickness of the abrasive portion. For example, the coating thickness can be not greater than about 5%, such as not greater than about 10%, not greater than about 20%, not greater than about 30%, not greater than about 40%, or even not greater than about 50% of the average thickness of the abrasive portion. Alternatively, the coating thickness can be at least about 0.01% of the average thickness of the abrasive portion, such as at least about 0.05%, at least about 0.10%, at least about 1%, at least about 5%, or even at least about 10%. In addition, the coating thickness can be in range between these minimum and maximum values.

The abrasive article may exhibit a Relative G-Ratio of at least 0.8 after 12 weeks with external conditions of 40° C. and 80% relative humidity. The abrasive article can have an internal relative humidity not greater than 50% at 20° C. after 25 weeks at 40° C. and 80% relative humidity.

Embodiments of a method of forming an abrasive article may include forming a body having an abrasive portion including a bond material and abrasive particles located within the bond material. The method may include applying a coating to at least a portion of an exterior surface of the abrasive portion, such that the coating couples to and overlies said at least a portion of an exterior surface of the abrasive portion, wherein the coating has a water vapor transmission rate (WVTR) of not greater than about 2 $g/m^2$-day. The WVTR may include the various values or ranges disclosed elsewhere herein. The coating may be applied by dipping, sputtering, printing, deposition, spraying, painting and a combination thereof. Alternatively, the coating may be applied by shrink wrapping or by vacuum wrapping. In other embodiments, the coating does not comprise shrink wrapping, nor does it comprise vacuum wrapping.

The coating can include a solvent other than water. Alternatively, the coating can include a water-based solvent, and can further include annealing the abrasive article to coalesce particles in the coating.

In a further example, a method of preparing a coated abrasive system includes determining a water vapor transfer rate (WVTR) of the coating, establishing conditions associated with a rating system, and determining an amount of coating to achieve a rating standard associated with the rating system. For example, the water vapor transfer rate and the conditions associated with the rating system can be applied to a simulation device that determines an amount of coating to achieve the rating standard.

In an example, the abrasive article is formed of abrasive grains bound by a binder system, such as an inorganic resin system. Exemplary abrasive grains include any one of or a combination of abrasive grains, including silica, alumina (fused or sintered), zirconia, zirconia/alumina oxides, silicon carbide, garnet, diamond, cubic boron nitride, silicon nitride, ceria, titanium dioxide, titanium diboride, boron carbide, tin oxide, tungsten carbide, titanium carbide, iron oxide, chromia, flint, emery, or any combination thereof. In an example, the abrasive grains include at least one type of primary abrasive grain selected from the group of abrasive families consisting of seeded or unseeded solgel alumina or Al2O3—ZrO2. A non-exhaustive list of abrasive grains from the seeded or unseeded sol gel alumina family that can be used include SG grain or NQ grain, commercially available from Saint-Gobain Abrasives, Inc. of Worcester, Mass., 3M321Cubitron grain or 3M324 Cubitron grain commercially available from 3M Corporation of St. Paul, Minn., or combinations thereof. A non-exhaustive list of abrasive grains from the Al2O3—ZrO2 family that can be used include NZ Plus grain, commercially available from Saint-Gobain Abrasives, Inc. of Worcester, Mass., ZF grain or ZS grain, commercially available from Saint-Gobain Abrasives, Inc. of Worcester, Mass., ZK40 grain or ZZK40 grain, commercially available from Treibacher Industry, Inc. of Toronto, Ontario CA, or ZR25B grain or ZR25R grain, commercially available from Alcan, Inc. of Montreal, Quebec CA. In an example, the amount of the primary abrasive grain comprises between about 0 percent to about 100 percent of the total amount of abrasive grain by volume.

In an embodiment, at least one type of secondary abrasive grain can be blended with the primary abrasive grain to achieve either cost or performance requirements. The secondary abrasive grain can be selected from the group consisting of ceramic oxides (e.g., coated or non-coated fused Al2O3, monocrystal Al2O3), minerals (e.g., garnet and emery), nitrides (e.g., Si3N4, AlN) and carbides (e.g., SiC). In an example, the amount of the secondary abrasive grain can range from about 100 to about 0 percent of the total amount of abrasive grain by volume or balance.

An exemplary binder system includes one or more organic resins, such as phenolic resin, boron-modified resin, nano-particle-modified resin, urea-formaldehyde resin, acrylic resin, epoxy resin, polybenzoxazine, polyester resin, isocyanurate resin, melamine-formaldehyde resin, polyimide resin, other suitable thermosetting or thermoplastic resins, or any combination thereof.

Specific, non-limiting examples of resins that can be used include the following: the resins sold by Dynea Oy, Finland, under the trade name Prefere and available under the catalog/product numbers 8522G, 8528G, 8680G, and 8723G; the resins sold by Hexion Specialty Chemicals, OH, under the trade name Rutaphen® and available under the catalog/product numbers 9507P, 8686SP, and SP223; and the resins sold by Sumitomo, formerly Durez Corporation, TX, under the following catalog/product numbers: 29344, 29346, and 29722. In an example, the bond material comprises a dry resin material.

An exemplary phenolic resin includes resole and novolac. Resole phenolic resins can be alkaline catalyzed and have a ratio of formaldehyde to phenol of greater than or equal to one, such as from 1:1 to 3:1. Novolac phenolic resins can be acid catalyzed and have a ratio of formaldehyde to phenol of less than one, such as 0.5:1 to 0.8:1.

An epoxy resin can include an aromatic epoxy or an aliphatic epoxy. Aromatic epoxies components include one or more epoxy groups and one or more aromatic rings. An example aromatic epoxy includes epoxy derived from a polyphenol, e.g., from bisphenols, such as bisphenol A (4,4'-isopropylidenediphenol), bisphenol F (bis[4-hydroxyphenyl]methane), bisphenol S (4,4'-sulfonyldiphenol), 4,4'-cyclohexylidenebisphenol, 4,4'-biphenol, 4,4'-(9-fluorenylidene)diphenol, or any combination thereof. The bisphenol can be alkoxylated (e.g., ethoxylated or propoxylated) or halogenated (e.g., brominated). Examples of bisphenol epoxies include bisphenol diglycidyl ethers, such as diglycidyl ether of Bisphenol A or Bisphenol F. A further example of an aromatic epoxy includes triphenylolmethane triglycidyl ether, 1,1,1-tris(p-hydroxyphenyl)ethane triglycidyl ether, or an aromatic epoxy derived from a monophenol, e.g., from resorcinol (for example, resorcin diglycidyl ether) or hydroquinone (for example, hydroquinone diglycidyl ether). Another example is nonylphenyl glycidyl ether. In addition, an example of an aromatic epoxy includes epoxy novolac, for example, phenol epoxy novolac and cresol epoxy novolac. Aliphatic epoxy components have one or more epoxy groups and are free of aromatic rings. The external phase can include one or more aliphatic epoxies. An example of an aliphatic epoxy includes glycidyl ether of C2-C30 alkyl; 1,2 epoxy of C3-C30 alkyl; mono or multi-glycidyl ether of an aliphatic alcohol or polyol such as 1,4-butanediol, neopentyl glycol, cyclohexane dimethanol, dibromo neopentyl glycol, trimethylol propane, polytetramethylene oxide, polyethylene oxide, polypropylene oxide, glycerol, and alkoxylated aliphatic alcohols; or polyols. In one embodiment, the aliphatic epoxy includes one or more cycloaliphatic ring structures. For example, the aliphatic epoxy can have one or more cyclohexene oxide structures, for example, two cyclohexene oxide structures.

An example of an aliphatic epoxy comprising a ring structure includes hydrogenated bisphenol A diglycidyl ether, hydrogenated bisphenol F diglycidyl ether, hydrogenated bisphenol S diglycidyl ether, bis(4-hydroxycyclohexyl)methane diglycidyl ether, 2,2-bis(4-hydroxycyclohexyl)propane diglycidyl ether, 3,4-epoxycyclohexylmethyl-3,4-epoxycyclohexanecarboxylate, 3,4-epoxy-6-methylcyclohexylmethyl-3,4-epoxy-6-methylcyclohexanecarboxylate, di(3,4-epoxycyclohexylmethyl) hexanedioate, di(3,4-epoxy-6methylcyclohexylmethyl) hexanedioate, ethylenebis(3,4-epoxycyclohexanecarboxylate), ethanedioldi(3,4-epoxycyclohexylmethyl) ether, or 2-(3,4-epoxycyclohexyl-5,5-spiro-3,4-epoxy)cyclohexane-1,3-dioxane.

An exemplary multifunctional acrylic can include trimethylolpropane triacrylate, glycerol triacrylate, pentaerythritol triacrylate, methacrylate, dipentaerythritol pentaacrylate, sorbitol triacrylate, sorbital hexacrylate, or any combination thereof. In another example, an acrylic polymer can be formed from a monomer having an alkyl group having from 1-4 carbon atoms, a glycidyl group or a hydroxyalkyl group having from 1-4 carbon atoms. Representative acrylic polymers include polymethyl methacrylate, polyethyl methacrylate, polybutyl methacrylate, polyglycidyl methacrylate, polyhydroxyethyl methacrylate, polymethyl acrylate, polyethyl acrylate, polybutyl acrylate, polyglycidyl acrylate, polyhydroxyethyl acrylate and mixtures thereof.

Depending upon the catalyzing agents and type of polymer, the binder system can be thermally curable or can be curable through actinic radiation, such as UV radiation, to form the binder system. The binder system can also include catalysts and initiators. For example, a cationic initiator can catalyze reactions between cationic polymerizable constituents. A radical initiator can activate free-radical polymerization of radically polymerizable constituents. The initiator can be activated by thermal energy or actinic radiation. For example, an initiator can include a cationic photoinitiator that catalyzes cationic polymerization reactions when exposed to actinic radiation. In another example, the initiator can include a radical photoinitiator that initiates free-radical polymerization reactions when exposed to actinic radiation. Actinic radiation includes particulate or non-particulate radiation and is intended to include electron beam radiation and electromagnetic radiation. In a particular embodiment, electromagnetic radiation includes radiation having at least one wavelength in the range of about 100 nm to about 700 nm and, in particular, wavelengths in the ultraviolet range of the electromagnetic spectrum.

The binder system can also include other components such as solvents, plasticizers, crosslinkers, chain transfer agents, stabilizers, dispersants, curing agents, reaction mediators and agents for influencing the fluidity of the dispersion. For example, the binder system can also include one or more chain transfer agents selected from the group consisting of polyol, polyamine, linear or branched polyglycol ether, polyester and polylactone.

Further, the binder system can include a filler. The fillers can include active and/or inactive fillers. A non-exhaustive list of active fillers can include Cryolite, PAF, KBF4, K2SO4, barium sulfate, sulfides (FeS2, ZnS), NaCl/KCl, low melting metal oxides, or combinations thereof.

A non-exhaustive list of inactive fillers can include CaO, CaCO3, Ca(OH)2, CaSiO3, Kyanite (a mixture of Al2O3—SiO2), Saran (Polyvinylidene chloride), Nephenline (Na, K) AlSiO4, wood powder, coconut shell flour, stone dust, feldspar, kaolin, quartz, other forms of silica, short glass fibers, asbestos fibers, balotini, surface-treated fine grain (silicon carbide, corundum etc.), pumice stone, cork powder and combinations thereof.

In a preferred embodiment, an active filler material, such as PAF, which is a mixture of K3AlF6 and KAlF4, can be added to the organic bond material in order to corrode metals and reduce the friction between the wheel and work piece. In a particular embodiment, the formulation of the abrasive mix used to form the abrasive article can be as follows. In an embodiment, the abrasive grains present in the mix can range from about 30 to about 70 percent by volume of the total mix (i.e., excluding porosity). In another embodiment, the abrasive grains present in the mix can range from about 40 to about 55 percent by volume of the total mix (i.e., excluding porosity). In one embodiment, the organic bond material (e.g., resin) in the mix can range from about 20 to about 45 percent by volume of the total mix. In another embodiment, the organic bond material (e.g., resin) in the mix can range from about 25 to about 40 percent by volume of the total mix. In an embodiment, the active filler materials in the mix can be in an amount that ranges from about 0 to about 25 percent by volume (amount in the total mix). In another embodiment, the active filler materials in the mix can be in an amount that ranges from about 5 to about 20 percent by volume (amount in the total mix). The balance will be inactive fillers.

In particular, the inorganic resin system can be hygroscopic or can include hygroscopic materials. Such hygroscopic materials can absorb water over time as it traverses the coating. It is believed that after moisture in the product exceeds certain level, the glass transition temperature of the binder matrix is reduced, resulting in the grinding performance degradation especially for dry grinding/cutting applications.

Further, the abrasive article can include one or more reinforcement layers. A reinforcement layer can be made of any number of various materials. An exemplary reinforcement layer includes a polymeric film (including primed films), such as a polyolefin film (e.g., polypropylene including biaxially oriented polypropylene), a polyester film (e.g., polyethylene terephthalate), or a polyamide film; a cellulose ester film; a metal foil; a mesh; a foam (e.g., natural sponge material or polyurethane foam); a cloth (e.g., cloth made from fibers or yams comprising fiberglass, polyester, nylon, silk, cotton, poly-cotton or rayon); a paper; a vulcanized paper; a vulcanized rubber; a vulcanized fiber; a nonwoven material; or any combination thereof, or treated versions thereof. A cloth backing can be woven or stitch bonded. In particular examples, the reinforcement layer is selected from a group consisting of paper, polymer film, cloth, cotton, poly-cotton, rayon, polyester, poly-nylon, vulcanized rubber, vulcanized fiber, fiberglass fabric, metal foil or any combination thereof. In other examples, the reinforcement layer includes a woven fiberglass fabric. In a particular example, the abrasive article includes one more layers of fiberglass between which abrasive grains are bound in a polymer matrix. For example, the abrasive article can have a configuration of aVa, VaV, VaVa, or VaVaV in which "V" is a reinforcement layer and "a" is an abrasive/binder mixture.

In the illustrated example, the abrasive article 10 is in the form of a thin-wheel abrasive article, such as a thin-wheel abrasive article for cutting applications. For example, the abrasive article can have a thickness, defined parallel to an axis of the abrasive article 100 and orthogonal to a radial dimension, in a range of 0.8 mm to 20 mm, such as a range of 0.8 mm to 15 mm, or even a range of 0.8 mm to 10 mm. Further, the thin-wheel abrasive article can have a diameter in a range of 50 mm to 400 mm, such as a diameter in a range of 75 mm to 230 mm, or even a range of 75 mm to 150 mm. In addition, the thin-wheel abrasive article can have a desirable aspect ratio, defined as the ratio of the diameter to the thickness, in a range of 5 to 160, such as a range of 15 to 160, a range of 15 to 150, or even a range of 20 to 125.

In an example, the coating 12 can have a thickness of at least 1 micron. For example, the thickness can be at least 10 microns, such as at least 100 microns, at least 125 microns, or even at least 500 microns. In a particular case in which the coating includes aluminum, the thickness is at least 1 micron. In contrast, typical metallized polymeric films include metal layer thicknesses on the order of less than 200 nanometers.

A method for preparing a coated abrasive article may include determining a water vapor transfer rate of a coating. In an example, the water vapor transfer rate (WVTR) can be determined using ASTM F1249-01 (Standard Test Method for Water Vapor Transmission Rate Through Plastic Film and Sheeting Using a Modulated Infrared Sensor). Alternatively, the water vapor transfer rate (WVTR) can be approximated using the material properties of the coating.

In addition, the method may include establishing the rating conditions. In an example, a rating system includes rating conditions to which an article to be tested is subjected and includes a rating standard relative to which performance of an exposed article is compared. A particular rating system includes testing a coated abrasive article under conditions of a particular temperature and a particular external relative humidity for a specified period (e.g., in total, equal to a desired shelf life). For example, the rating condition can include a temperature of 25° C. and a relative humidity of 70% for 25 weeks. In another example, the temperature can be 40° C. and the relative humidity can be 80% for 25 weeks. In an alternative example, a set of conditions to be applied during contiguous periods can be specified. For example, a set of conditions selecting a temperature in a range of 20° C. to 40° C. and a relative humidity in a range of 40% to 90% for contiguous periods of time, such as between 2 and 8 contiguous periods, each having a length of between 1 hours and 8 hours, can be specified. The rating standard can be expressed in terms of a not-to-exceed amount, such as a not-to-exceed internal relative humidity on an inside of the coating or a not-to exceed amount of moisture gain in the abrasive article, over the period of time (e.g., desired shelf life) of the rating conditions, such as a period selected between 10 to 30 weeks, a range of 10 to 25 weeks, or even a range of 10 to 20 weeks. An exemplary rating standard includes not greater than 50% relative humidity (RH) at 20° C. for a period of 12 weeks, not greater than 50% relative humidity at 20° C. for a period of 25 weeks, or not greater than 0.6 wt % moisture gain over a period of 25 weeks.

For example, the method can include determining a water vapor transfer rate (WVTR) of a coating. For example, the water vapor transfer rate (WVTR) of a particular coating can be measured in according with an ASTM standard. A set of rating conditions can be selected. For example, the rating conditions can include a temperature, a relative humidity, and a period of time. A rating standard can include a relative humidity inside the coating not to be exceeded.

A simulation device can be used to determine whether the parameters associated with the coating are adequate to provide a rating as prescribed. For example, the simulation device can access the parameters and can integrate a set of relationships based on the provided conditions and water vapor transfer rate (WVTR) to provide an output that can be compared with a set of rating standards. In a particular example, the rate of change of the internal relative humidity is a function of a rate of water vapor transfer into the coating. The rate of water vapor transfer is proportional to a difference in the internal and external relative humidities. In addition, the internal relative humidity can be a function of the absorption of moisture by the abrasive article. The rate of absorption of moisture by the abrasive article can be proportional to the internal relative humidity and a function of the temperature.

In addition, the simulation device can determine whether the coating is adequate to limit the relative humidity or water weight gain in the abrasive article to less than a specified amount over a period of time. The simulation device can again determine based on the rating conditions a relative humidity (RH) or moisture gain in an abrasive product, and compare the relative humidity (RH) or moisture gain to the rating standard. The process can be iterated until the rating standard is achieved. When the rating standard is achieved, coated abrasive products can be prepared using the amount of coating determined through the iterative process.

In a particular example, the rating conditions internal to the coating, such as the relative humidity or moisture gain of the abrasive product can be expressed in terms of a differential equation that is integrated, such as through numerical techniques within the simulation device. For example, a change in relative humidity internal to the coating can be expressed in terms of an influx of water as a result of the permeability of a coating.

The abrasive article can be made by forming a mixture of components or precursor components that may be part of the final abrasive article. For example, the mixture can include components of the final abrasive article, such as abrasive particles, bond material, filler, and a combination thereof. In one embodiment, the mixture can include a first type of abrasive particle. A type of abrasive particle can be defined by at least a composition, a mechanical property (e.g., hardness, friability, etc.), particle size, a method of making, and a combination thereof.

The abrasive tools may utilize abrasive portions of abrasive grains contained within a matrix material for cutting, abrading, and finishing of workpieces. Certain embodiments herein are directed to large-diameter abrasive wheels incorporating one or more reinforcing members within the body of the tool that are particularly suited for cutting and/or shaping metal.

Cut Off Wheels

Again referring to FIG. 3, an embodiment of an abrasive tool 100 includes a body 101 having a generally circular shape as viewed in two dimensions. It will be appreciated, that in three-dimensions the tool has a certain thickness such that the body 101 has a disk-like or a cylindrical shape. As illustrated, the body can have an outer diameter 103 extending through the center of the tool, which can be particularly large, having a dimension of at least about 45 cm. In other applications, the body 101 can have an outer diameter 103, such as on the order of at least about 60 centimeters, at least about 75 centimeters, or even at least 100 centimeters. Particular abrasive tools utilize a body 101 having an outer diameter 103 within a range between 45 centimeters and about 200 centimeters, such as between 45 cm and about 175 cm, and more particularly between about 45 centimeters and about 150 centimeters.

As further illustrated, the abrasive tool 100 can include a central opening 105 defined by an inner circular surface 102 about the center of the body 101. The central opening 105 can extend through the entire thickness of the body 101 such that the abrasive tool 100 can be mounted on a spindle or other machine for rotation of the abrasive tool 100 during operation.

FIG. 4 includes a cross-sectional illustration of a portion of an abrasive tool 200 in accordance with an embodiment. The abrasive body 201 can be a composite article including a combination of portions of different types of material. In particular, the body 201 can include abrasive portions 204, 206, 208, and 210 and reinforcing members 205, 207, and 209. The abrasive tool 200 can be designed such that the reinforcing members 205, 207, and 209 can be placed within the body such that they are spaced apart from each other, and therein, separate each of the abrasive portions 204, 206, 208, and 210 from each other. That is, the abrasive tool 200 can be formed such that the reinforcing members 205, 207, and 209 are spaced apart from each other laterally through the thickness 212 of the body 201 and separated by abrasive portions 206 and 208. As will be appreciated, in such a design the abrasive portions 206 and 208 can be disposed between the reinforcing members 205, 207, and 209.

As further illustrated, the reinforcing members 205, 207, and 209 can be substantially planar members having first planar faces and second planar faces. For example, the reinforcing member 205 can be formed such that it is a planar member having a first major surface 215 and a second major surface 216. Moreover, the body 201 can have a design such that the abrasive portions 204, 206, 208, and 210 can overlie the major surface of the reinforcing members 205, 207, and 209. For example, the abrasive portion 204 can overlie the first major surface 215 of the reinforcing member 205 and the abrasive portion 206 overlies the second major surface 216 of the reinforcing member 205. In particular instances, the body 201 can be formed such that the abrasive portions 204 and 206 cover essentially the entire surface area of the first major surface 215 and second major surface 216, respectively. Accordingly, the abrasive portions 204 and 206 can directly contact (i.e. abut) the reinforcing member 205 on either sides at the first and second major surfaces 215 and 216.

Notably, the abrasive body 201 can be designed such that the reinforcing members 205, 207, and 209 can extend through a majority of the diameter 103 of the body 201. In particular instances, the reinforcing members 205, 207, and 209 can be formed such that they extend through at least about 75%, such as at least about 80%, or even the entire diameter 103 of the body 201.

In accordance with an embodiment, the body 201 is formed such that it can have an average thickness 212 measured in a direction parallel to the axial axis 250 extending through the center of the central opening 105. The average thickness 212 of the body 201 can be particularly thin such that it is suitable for cutting metal workpieces. For example, the average thickness of the body 201 can be not greater than about 3 centimeters. In other embodiments, the average thickness 212 of the body 201 can be not greater than about 2.5 centimeters, such as not greater than about 2 centimeters, or even not greater than about 1.5 centimeters. Still, certain embodiments may utilize an average thickness 212 within a range between about 0.5 centimeters and about 3 centimeters, such as between about 0.5 centimeters and about 2 centimeters.

The disk may have an aspect ratio defined as a ratio (D:T) between the outer diameter 103 to an axial thickness 212 of the body. The ratio (D:T) can be at least about 10:1, such as at least about 20:1, at least about 50:1, or even at least about 75:1. Certain embodiments utilize an aspect ratio within a range between about 10:1 and about 125:1, such as between about 20:1 and about 125:1.

In further reference to the reinforcing members 205, 207, and 209, such members can be made of an organic material, inorganic material, and a combination thereof. For example, the reinforcing members 205, 207, and 209 can be made of an inorganic material, such as a ceramic, a glass, quartz, or a combination thereof. Particularly suitable materials for use as the reinforcing members 205, 207, and 209 can include glass materials, incorporating fibers of glass materials, which may include oxide-based glass materials.

Some suitable organic materials for use in the reinforcing members 205, 207, and 209 can include phenolic resin, polyimides, polyamides, polyesters, aramids, and a combination thereof. For example, in one particular embodiment, the reinforcing members 205, 207, and 209 can include Kevlar™, a particular type of aramid.

Additionally, the reinforcing members 205, 207, and 209 can include a fibrous material having a coating overlying and bonded directly to the external surfaces of the fibers. The coating can be an organic material, inorganic material, or a combination thereof. Certain abrasive tools can use reinforcing members 205, 207, and 209 utilizing fibers having a coating of an organic material, which may be a natural organic material or a synthetic organic material, such as a polymer, which may aid bonding between the reinforcing member and the abrasive portion. Some suitable organic coating materials can include resins, which may be thermosets, thermoplastics, or a combination thereof. Particularly suitable resins can include phenolics, epoxies, polyesters, cyanate esters, shellacs, polyurethanes, and a combination thereof. In one particular instance, the abrasive tool incorporates a reinforcing member comprising phenolic resin-coated glass fibers.

The reinforcing members 205, 207, and 209 can include a plurality of fibers that are woven together. The fibers can be woven or stitched together in a variety of manners. In certain instances, the reinforcing members can be woven together such that a pattern is formed, including fibers extending primarily in two perpendicular directions.

The reinforcing members 205, 207, and 209 can have an average thickness 218 that is defined as the distance between the first major surface 215 and the second major surface 216 of the reinforcing member 205. The average thickness 218 can be less than 0.6 centimeters, such as less than 0.6 centimeters, or even less than 0.4 centimeters.

In relative percentages, depending upon the design of the abrasive article, the reinforcing members can be formed to have certain dimensions such that they compose a certain percentage of the total average thickness of the body. For example, the reinforcing member 205 can have an average thickness 218 that is at least about 3% of the total average thickness 212 of the body 201. In other instances, the reinforcing member 205 can have an average thickness 218 that is at least about 5%, such as at least about 8%, or even at least about 10% of the total average thickness 212 of the body 201. Certain reinforcing members can have an average thickness 218 that is within a range between about 3% and about 15% of the total average thickness 212 of the body 201.

In accordance with embodiments herein, the abrasive tool 200 is formed such that the body 201 includes abrasive portions 204, 206, 208, and 210. Reference will be made in the following paragraphs to the abrasive portion 204, however it will be appreciated that all of the identified abrasive portions can include the same features. The abrasive portion 204 can be a composite material having abrasive grains contained within a matrix material and further comprising a particular composition and type of porosity.

The abrasive grains can include a particularly hard material suitable for abrading and material removal applications. For example, the abrasive grains can have a Vickers hardness of at least about 5 GPa. The hardness of the abrasive grains can be greater in some tools, such that the abrasive grains have a Vickers hardness of at least about 10 GPa, at least about 20 GPa, at least about 30 GPa, or even at least about 50 GPa.

As further illustrated in FIG. 4, the body can be formed such that it incorporates reinforcing members 202 and 203 that abut the outer surfaces of the abrasive portions 204 and 210 about the central opening 105. In certain designs, the reinforcing members 202 and 203 can extend for a portion of the outer diameter 103, such as half the outer diameter 103 of the abrasive body 201. Provision of the reinforcing members 202 and 203 about the central opening 105 facilitates reinforcement of the body 201 at a location where the abrasive tool 200 is intended to be affixed to a spindle or machine. As will be appreciated, the reinforcing members 202 and 203 can have the same features as the reinforcing members 205, 207, and 209.

Figure 5:
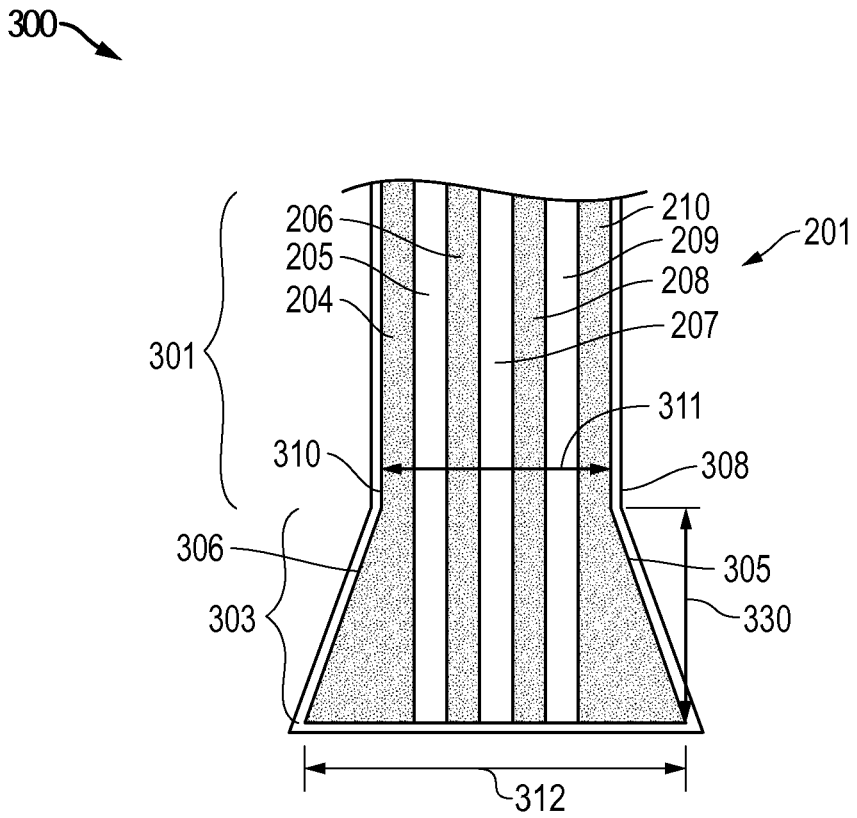
FIG. 5 includes a sectional illustration of a portion of an abrasive tool in accordance with an embodiment.

FIG. 5 includes a cross-sectional illustration of a portion of an abrasive tool in accordance with an embodiment. The portion of the illustrated abrasive tool 300 includes an outer circumference of an abrasive tool formed in accordance with an embodiment. Particularly, the portion of the abrasive tool 300 can have a body 201 including abrasive portions 204, 206, 208, and 210 previously described. Moreover, the abrasive body 201 includes reinforcing members 205, 207, and 209 disposed between the abrasive portions 204, 206, 208, and 210 as previously described.

Notably, the body 201 is formed such that it has a flat region 301 proximate to the center of the wheel and surrounding the central opening 105, and a tapered region 303 at the outer edge of the body 201. As illustrated, the tapered region 303 is formed such that it has an average thickness 312 measured at the outer diameter of the body 201 that is significantly greater than the average thickness 311 of the body 201 within the flat region 301. The formation of the tapered region 303 is facilitated by the extension of a tapered edge 305 of the abrasive portion 210 that extends at an angle to the external surface 308 of the flat region 301 of the abrasive portion 210. The tapered region 303 is further defined by a tapered surface 306 of the abrasive portion 204, which extends at an angle to the surfaces 310 of the abrasive portion 204. As illustrated, the tapered region 303 can form a rim around the outer diameter of the wheel, wherein the tapered surfaces 305 and 306 extend at an angle axially outward from the surfaces 308 and 310, respectively. The tapered surfaces 305 and 306 can extend at an angle to a radius extending from the center of the body substantially parallel to the surfaces 308 and 310, and moreover, the tapered surfaces 305 and 306 can extend at an angle to an axial axis 250 extending through the center of the body 201.

According to some embodiments, the tapered region 303 can extend circumferentially around a portion of a periphery of the body 201. Certain designs may utilize a tapered region 303 that extends throughout the entire circumference of the body 201. While reference is made herein to abrasive articles incorporating a tapered region 303, it will be appreciated, that a tapered region 303 may not necessarily be present for certain abrasive articles.

As illustrated, the tapered region 303 can extend radially from the flat region 301 of the body 201. Embodiments herein may form a tapered region 303 having a length 330, as measured in a direction parallel to a radius extending from the center of the body 201, which can be a particular percentage of the dimension of the outer diameter 103 of the body 201. For example, the tapered region 303 can have a length 330 that is at least about 5% of the dimension of the outer diameter 103. In other cases, depending upon the intended application, the body 201 can have a tapered region 303 having a length 330 of at least about 10%, such as at least about 15%, at least about 20%, at least about 30%, or even at least about 35%, of the dimension of the outer diameter 103. Particular embodiments can utilize a tapered region 303 wherein the length 330 is within a range between about 5% and about 50%, and particularly between about 5% and about 35%, or even more particularly between about 5% and about 20% of the outer diameter 103.

In other terms, the length 330 of the tapered region can be at least about 10 centimeters. In some embodiments, the length 330 of the tapered region 303 can be greater, such as at least about 13 centimeters, at least about 15 centimeters, or even at least about 20 centimeters. Still, particular embodiments herein can utilize a tapered region 303 having a length 330 within a range between about 10 centimeters and about 30 centimeters, such as between about 10 centimeters and about 20 centimeters.

The abrasive particles of the mixture and the final-formed abrasive article may include more than one type of abrasive particle. For example, the mixture can include a second type of abrasive particle different than the first type of abrasive particle. The second type of abrasive particle can differ from the first type of abrasive particle by any one of a composition, a mechanical property (e.g., hardness, friability, etc.), particle size, a method of making, or a combination thereof.

Grinding Wheels

In some examples, such as grinding wheels, the axial thickness of the wheel is less than about 13 cm, for example, less than about 12 cm, less than about 11 cm, less than about 10 cm, less than about 9 cm, less than about 8 cm, less than about 7 cm, or even less than about 6 cm, and is at least about 5 cm.

Such abrasive wheels described herein can have an outer diameter that is at least about 30 cm, such as at least about 40 cm. The diameter may be greater, such as at least about 50 cm, at least about 60 cm, at least about 70 cm, or at least about 80 cm. In particular instances, the diameter is within a range between about 30 cm and 100 cm, such as between about 40 cm and about 80 cm.

Ratios between wheel diameter and wheel thickness (diameter:thickness) can be within a range between about 20:1 to about 2:1, e.g., between about 15:1 to about 5:1. It can be practiced with wheels having different dimensions and different ratios between dimensions.

Bonded abrasive tools such as grinding wheels, can be prepared by combining abrasive grains, a bonding material, e.g., an organic (resin), and in many cases other ingredients, such as, for instance, fillers, processing aids, lubricants, crosslinking agents, antistatic agents and so forth, as described elsewhere herein.

According to another embodiment, the abrasive particles can be shaped abrasive particles. Shaped abrasive particles can have a well-defined and regular arrangement (i.e., non-random) of edges and sides, thus defining an identifiable shape. For example, a shaped abrasive particle may have a polygonal shape as viewed in a plane defined by any two dimensions of length, width, and height. Some exemplary polygonal shapes can be triangular, quadrilateral (e.g., rectangular, square, trapezoidal, parallelogram), a pentagon, a hexagon, a heptagon, an octagon, a nonagon, a decagon, and the like. Additionally, the shaped abrasive particle can have a three-dimensional shape defined by a polyhedral shape, such as a prismatic shape or the like. Further, the shaped abrasive particles may have curved edges and/or surfaces, such that the shaped abrasive particles can have convex, concave, ellipsoidal shapes.

The shaped abrasive particles can be in the form of any alphanumeric character, e.g., 1, 2, 3, etc., A, B, C. etc. Further, the shaped abrasive particles can be in the form of a symbol, trademark, a character selected from the Greek alphabet, the modern Latin alphabet, the ancient Latin alphabet, the Russian alphabet, any other alphabet (e.g., Kanji characters), and any combination thereof.

The shaped abrasive particle can have a body defining a length (l), a height (h), and a width (w), wherein the length is greater than or equal to the height, and the height is greater than or equal to the width. Further, in a particular aspect, the body may include a primary aspect ratio defined by the ratio of length:height of at least about 1:1. The body may also include an upright orientation probability of at least about 50%.

In another aspect, the shaped abrasive particle can have a body having a length (l), a width (w), and a height (h), wherein the length, width, and height may correspond to a longitudinal axis, a lateral axis, and a vertical axis, respectively, and the longitudinal axis, lateral axis, and vertical axis may define three perpendicular planes. In this aspect, the body may include an asymmetric geometry with respect to any of the three perpendicular planes.

In yet another aspect, the shaped abrasive particle may include a body having a complex three-dimensional geometry including 3-fold symmetry in three perpendicular planes defined by a longitudinal axis, a lateral axis, and a vertical axis. Further, the body may include an opening that extends through the entire interior of the body along one of the longitudinal axis, lateral axis, or vertical axis.

In still another aspect, the shaped abrasive particle may include a body having a complex three-dimensional geometry defined by a length (l), a width (w), and a height (h). The body may also include a center of mass and a geometric midpoint. The center of mass may be displaced from the geometric midpoint by a distance (Dh) of at least about 0.05 (h) along a vertical axis of the body defining the height.

In another aspect, the shaped abrasive particle may include a body that defines a length (l), a width (w), and a height (h). The body may include a base surface and an upper surface. Further, the base surface comprises a different cross-sectional shape than a cross-sectional shape of the upper surface.

In still another aspect, the shaped abrasive particle may include a body that has a generally flat bottom and a dome shaped top extending from the generally flat bottom.

In another aspect, the shaped abrasive particle may include a body comprising a length (l), a width (w), and a height (h). The length, width, and height may correspond to a longitudinal axis, a lateral axis, and a vertical axis, respectively. Further, the body may include a twist along a longitudinal axis defining the length of the body such that a base surface is rotated with respect to an upper surface to establish a twist angle.

In yet another aspect, the shaped abrasive particle may include a body having a first end face and a second end face a, at least three adjacent side faces extending between the first end face and the second end face, and an edge structure established between each pair of adjacent side faces. In another aspect, the shaped abrasive particle may include a body having a central portion and at least three radial arms extending outwardly from the central portion along the entire length of the central portion.

This written description uses examples to disclose the embodiments, including the best mode, and also to enable those of ordinary skill in the art to make and use the. The patentable scope is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

Note that not all of the activities described above in the general description or the examples are required, that a portion of a specific activity may not be required, and that one or more further activities may be performed in addition to those described. Still further, the order in which activities are listed are not necessarily the order in which they are performed.

In the foregoing specification, the concepts have been described with reference to specific embodiments. However, one of ordinary skill in the art appreciates that various modifications and changes can be made without departing from the scope as set forth in the claims below. Accordingly, the specification and figures are to be regarded in an illustrative rather than a restrictive sense, and all such modifications are intended to be included within the scope of.

As used herein, the terms "comprises," "comprising," "includes," "including," "has," "having" or any other variation thereof, are intended to cover a non-exclusive inclusion. For example, a process, method, article, or apparatus that comprises a list of features is not necessarily limited only to those features but may include other features not expressly listed or inherent to such process, method, article, or apparatus. Further, unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present).

Also, the use of "a" or "an" are employed to describe elements and components described herein. This is done merely for convenience and to give a general sense of the scope. This description should be read to include one or at least one and the singular also includes the plural unless it is obvious that it is meant otherwise.

Benefits, other advantages, and solutions to problems have been described above with regard to specific embodiments. However, the benefits, advantages, solutions to problems, and any feature(s) that may cause any benefit, advantage, or solution to occur or become more pronounced are not to be construed as a critical, required, or essential feature of any or all the claims.

After reading the specification, skilled artisans will appreciate that certain features are, for clarity, described herein in the context of separate embodiments, may also be provided in combination in a single embodiment. Conversely, various features that are, for brevity, described in the context of a single embodiment, may also be provided separately or in any subcombination. Further, references to values stated in ranges include each and every value within that range.

What is claimed is:

1. An abrasive article, comprising:

a body comprising:

an abrasive portion including a bond material; and abrasive particles located within the bond material;

wherein the body comprises a coating bonded directly to and overlying at least a portion of an exterior surface of the abrasive portion, wherein the coating has a water vapor transmission rate (WVTR) of not greater than about 2 $g/m^2$-day, wherein the coating includes a first film comprising a metal layer and a second film comprising a polymeric material, and wherein the coating does not include shrink wrapping, vacuum wrapping, or a combination thereof.

2. The abrasive article of claim 1, wherein the coating is configured to be selectively removable when the abrasive portion is used.

3. The abrasive article of claim 1, wherein the body comprises a peripheral portion and the abrasive portion is at least partially disposed at the peripheral portion.

4. The abrasive article of claim 1, wherein the body comprises a first major face defining a working surface, and the coating overlies essentially an entirety of the working surface.

5. The abrasive article of claim 1, wherein the metal layer of the coating comprises a composition selected from the group consisting of aluminum, copper, nickel, alloys and any combination thereof.

6. The abrasive article of claim 1, wherein the coating comprises an oxide, carbide, nitride, SiC, polyethylene, saran, or any combination thereof.

7. The abrasive article of claim 1, wherein the coating has a thickness of at least about 0.2 microns.

8. The abrasive article of claim 1, wherein the coating is non-abrasive.

9. The article of claim 1, wherein the abrasive article exhibits a Relative G-Ratio of at least 0.8 after 12 weeks with external conditions of 40° C. and 80% relative humidity.

10. The article of claim 1, wherein the abrasive article has an internal relative humidity not greater than 50% at 20° C. after 25 weeks at 40° C. and 80% relative humidity.

11. The abrasive article of claim 1, wherein the abrasive portion has an abrasive hardness, and the coating has a coating hardness that is less than the abrasive hardness.

12. The abrasive article of claim 1, wherein the coating further comprises a desiccant layer.

13. The article of claim 1, wherein the polymeric material of the coating comprises a composition selected from the group consisting of a polyester, polyethylene terephthalate, liquid crystal polymer, aromatic polyester polymers, and any combination thereof.

14. The article of claim 1, wherein the metal layer and the polymeric material are in direct contact with each other.

15. The article of claim 1, wherein at least one of the metal layer and the polymeric material is in direct contact with the abrasive portion.

16. The article of claim 13, wherein the polymeric material of the coating comprises a polyester.

17. The article of claim 14, wherein the polyester comprises polyethylene terephthalate, liquid crystal polymer, or a combination thereof.

18. An abrasive article, comprising:

a body comprising:

an abrasive portion including a bond material; and abrasive particles located within the bond material;

wherein the body comprises a coating bonded directly to and overlying at least a portion of an exterior surface of the abrasive portion;

wherein the coating has a water vapor transmission rate (WVTR) of not greater than about 2 $g/m^2$-day;

wherein the coating includes a first film comprising a metal layer and a second film comprising a polymeric material; and wherein the coating is configured to be selectively removable when the abrasive portion is used.

19. An abrasive article, comprising:

a body comprising:

an abrasive portion including a bond material; and abrasive particles located within the bond material;

wherein the body comprises a coating bonded directly to and overlying at least a portion of an exterior surface of the abrasive body;

wherein the coating has a water vapor transmission rate (WVTR) of not greater than about 2 $g/m^2$-day;

wherein the coating includes a first film comprising a metal layer and a second film comprising a polymeric material; and wherein the coating is applied to the abrasive body by dipping, sputtering, printing, deposition, spraying, painting, or a combination thereof.

20. The abrasive article of claim 19, wherein the coating is configured to be selectively removable when the abrasive portion is used.

* * * * *